United States Patent [19]

Stiefel et al.

[11] Patent Number: 5,009,427

[45] Date of Patent: Apr. 23, 1991

[54] GOLF BALL

[75] Inventors: Joseph F. Stiefel, Shrewsbury, Mass.; Terence Melvin, Somers, Conn.; R. Dennis Nesbitt, Westfield, Mass.

[73] Assignee: Spalding & Evenflo Companies, Inc., Tampa, Fla.

[21] Appl. No.: 534,087

[22] Filed: Jun. 6, 1990

[51] Int. Cl.[5] ..... A63B 37/14

[52] U.S. Cl. ..... 273/232; 40/327

[58] Field of Search ..... 273/232, 235 R; 40/327; D21/204, 205

[56] References Cited

U.S. PATENT DOCUMENTS

| | | | |
|---|---|---|---|
| 4,729,861 | 3/1988 | Lynch et al. | 264/219 |
| 4,804,189 | 2/1989 | Gobush | 273/232 |
| 4,813,677 | 3/1989 | Oka et al. | 273/232 |
| 4,840,381 | 6/1989 | Ihara et al. | 273/232 |
| 4,880,241 | 11/1989 | Melvin et al. | 273/232 |
| 4,915,390 | 4/1990 | Gobush et al. | 273/232 |
| 4,936,587 | 6/1990 | Lynch et al. | 273/232 |

*Primary Examiner*—George J. Marlo

*Attorney, Agent, or Firm*—Donald R. Bahr; John E. Benoit

[57] ABSTRACT

A dimpled configuration for a golf ball wherein the dimples are arranged in a modified icosahedral lattice comprising a first set of five adjacent triangles on either side of the equator of the ball, with the vertices of each of the triangles being located at each pole of the ball and the sides opposite the polar vertices being spaced a distance from the equator of the ball. A second set of five triangles smaller than the first set of triangles equally spaced between the first set of triangles and the equator of the ball, each of the second set of triangles having a vertex common with adjacent ones of the first set of triangles, with the leg opposite the common vertex being parallel to but spaced from the equator. A first plurality of dimples having a diameter D1 lying along the lattice forming the first and second set of triangles, and a second plurality of dimples having a diameter D2 within the lattice of the first and second set of triangles and between the lattice of the second set of triangles, D1 being greater than D2, with a dimple-free line about the equator of the ball.

6 Claims, 2 Drawing Sheets

GOLF BALL

This invention relates generally to golf balls and more particularly to a specific arrangement of the dimples on a golf ball.

It is generally known that for any given selected number of dimples on a golf ball, it is desirable that the area of the surface of the golf ball covered by the dimples be a maxmimum in order to provide the best flight characteristics for a golf ball. In British Patent Provisional Specification Serial No. 377,354, filed May 22, 1931, in the name of John Vernon Pugh, there is disclosed the fact that by the use of an icosahedral lattice for defining dimple patterns on a golf ball it is possible to make a geometrically symmetrical ball. This icosahedral lattice is developed by the known division of a sphere or spherical surface into like areas determined by an inscribed regular polyhedron such as an icosahedron. The Pugh specification specifically details the means of plotting the icosahedron on the surface of the golf ball and, accordingly, will not be dealt with in detail here. Thus, with a selected number and size of the dimples placed in this icosahedral pattern, the area of the surface of the ball covered by the dimples is fixed.

A problem arises with the Pugh icosahedron golf ball in that there is no equatorial line on the ball which does not pass through some of the dimples on the ball. Since golf balls are molded and manufactured by using two hemispherical half molds normally having straight edges, the ball, as it comes from the mold, has a flash line about the equatorial line created by the two hemispheres of the mold. Such molding results in a clear flash line. Even if the ball could be molded with dimples on the flash line, the ball could not be properly cleaned and finished in any efficient manner since the flash could not be cleaned from the bottom of the dimple without individual treatment of each dimple.

The Pugh ball is geometrically symmetrical. Any changes in dimple location which affect the aerodynamic symmetry under U.S.G.A. standards will render the ball illegal for sanctioned play. Many proposals have been made and balls have been constructed with a modification of the Pugh icosahedral pattern so as to provide an equatorial line which is free of dimples. Again, it is emphasized that any such modification must be aerodynamically symmetrical.

U.S.G.A. rules of golf require that the ball shall be designed and manufactured to perform in general as if it were aerodynamically symmetrical. A golf ball which is dimpled in some manner may be geometrically symmetrical and not aerodynamically symmetrical. A perfect example of a golf ball which is both geometrically symmetrical and aerodynamically symmetrical is a smooth sphere. As is well known, this ball is not capable of providing the necessary performance required in present day golf. To conform, all balls must be aerodynamically symmetrical. This symmetry is determined by actual tests of the ball as it is being struck by a machine which belongs to the U.S.G.A.

It has also been found that it is desirable to cover as much as the surface as possible with the dimples. While a great deal of the surface may be covered by making the dimples quite small, it has been found that this imparts some undesirable characteristics to the ball. At the same time, when larger diameter dimples are used and all the dimples are the same size, there is a considerable surface of the ball remaining after the dimples are arranged on the surface.

Accordingly, it is an object of the present invention to provide a dimpled golf ball wherein a substantially maximum area of the surface is covered by dimples.

It is yet another object of the present invention to provide a dimpled golf ball wherein the dimples are specifically arranged using two different sized dimples while still maintaining a dimple-free equatorial line.

These and other objects of the invention will become apparent from the following description taken together with the drawings.

SUMMARY OF THE INVENTION

The present invention provides a golf ball having a dimpled configuration wherein the dimples are arranged in a geometrical lattice configuration with a set of five adjacent triangles on either side of the equatorial line of the ball, each set having common vertices at the poles. The lattice configuration additionally includes a set of five smaller triangles on either side of the equatorial line of the ball, with each small triangle having its upper vertex common with the lower vertices of two adjacent larger triangles. The legs of the smaller triangles opposite such vertices are substantially parallel to but spaced from the equatorial line of the ball. All of the dimples lying on the lattice of both triangles are of a diameter D1, with the remaining dimples lying within the larger triangles and between the smaller triangles being of a diameter D2, which is smaller than the diameter D1. A dimple-free equatorial line is created about the ball.

DETAILED DESCRIPTION OF THE PREFERRED EMBODIMENT

Figure 1:
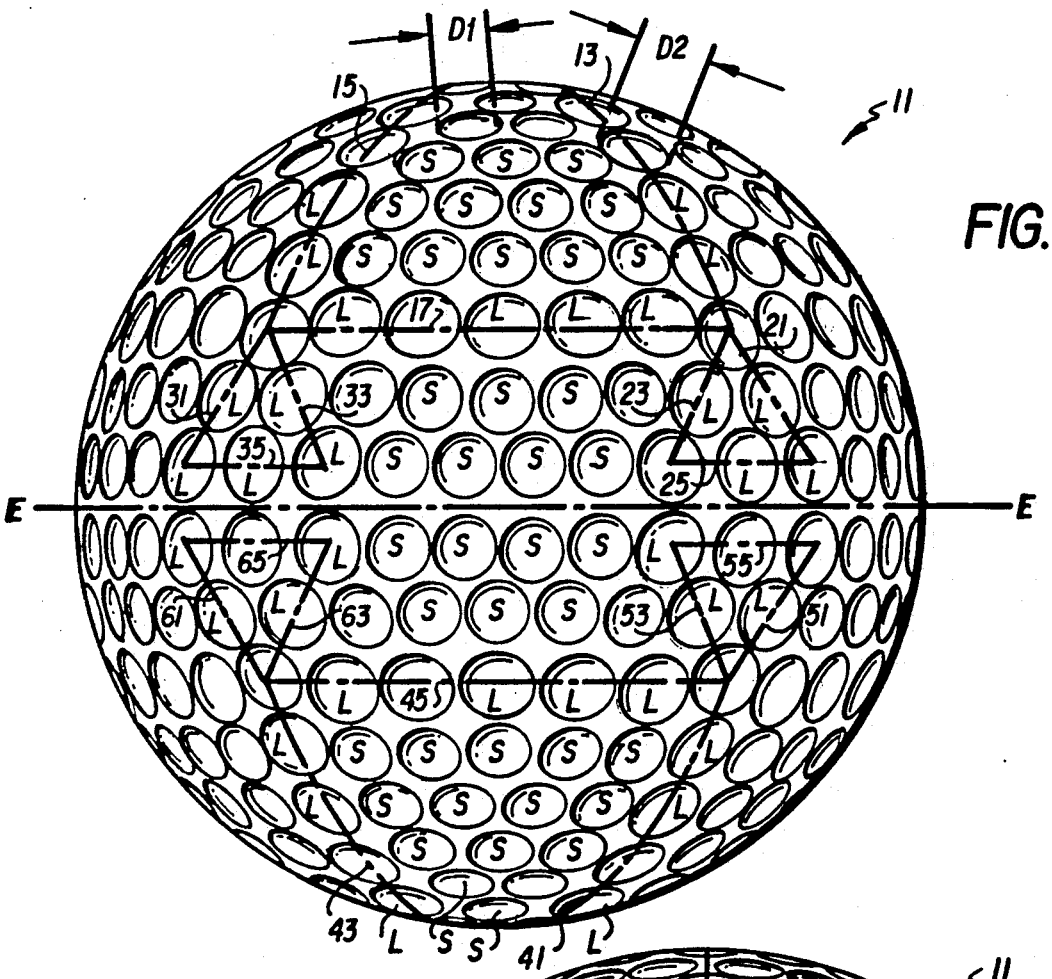
FIG. 1 is a plan view taken along the equatorial line of the ball of the present invention.
Figure 2:
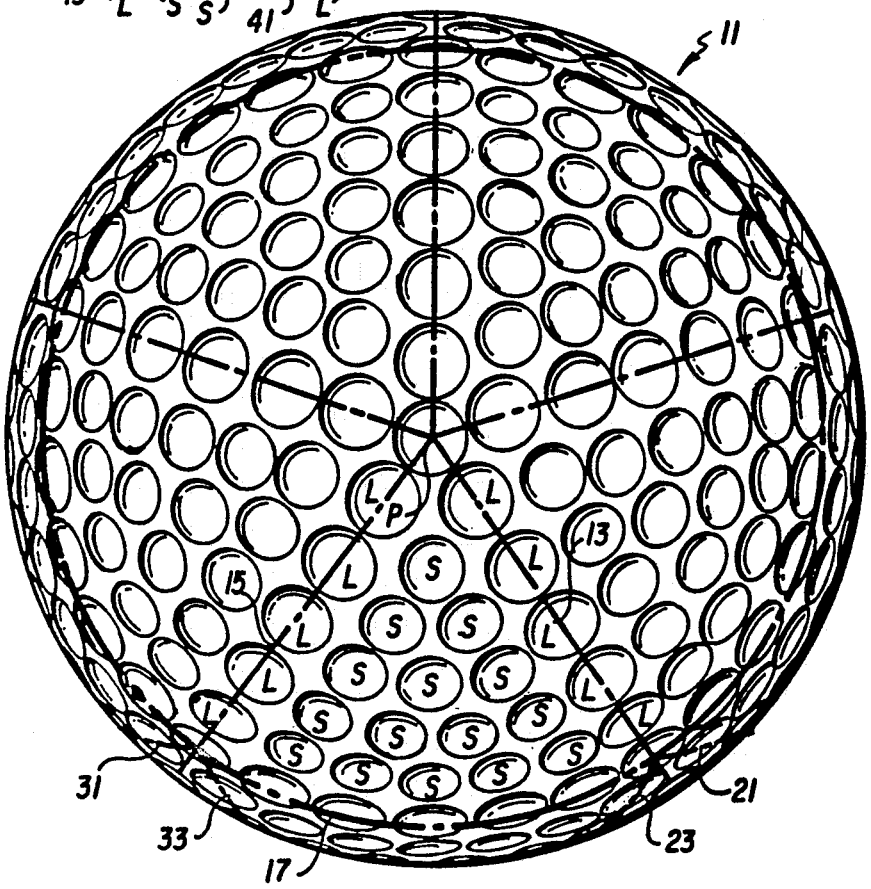
FIG. 2 is a top plan view taken from one of the poles of the ball of FIG. 2.
Figure 3:
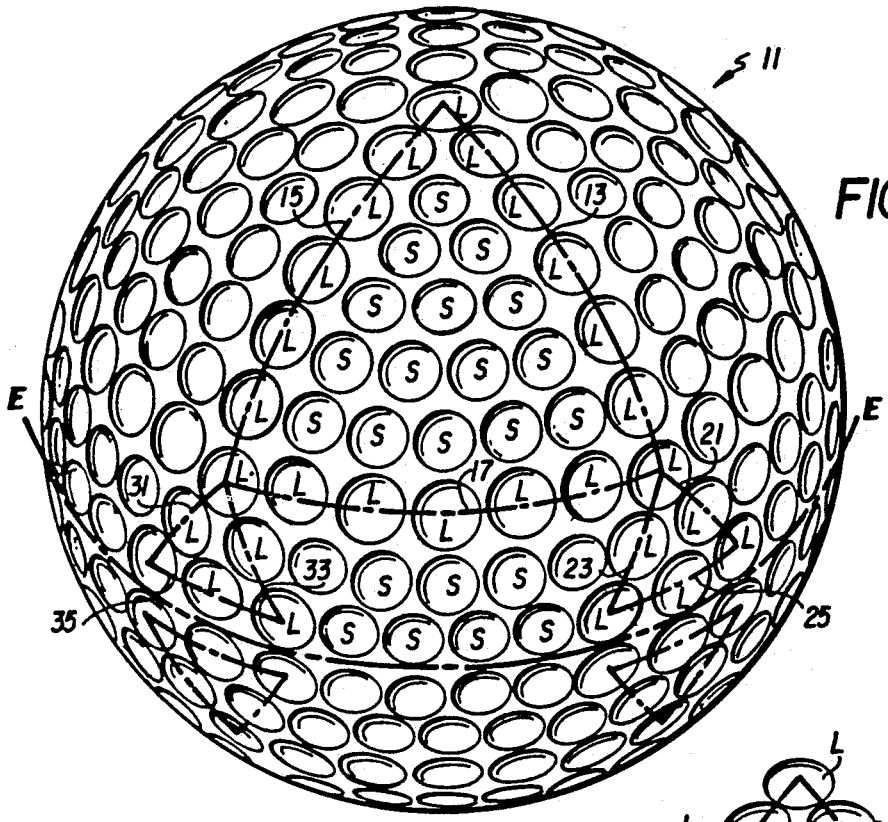
FIG. 3 is a plan view taken along an offset line from the equatorial line of the ball of FIG. 1.

Referring to FIGS. 1, 2, and 3, there is shown a golf ball having a first set of dimples of a diameter D1 and a second set of dimples of a diameter D2. The golf balls each consist of five basic sections on either hemisphere of the ball, with the sections being mirror images of each other. Since all sections on each hemisphere are identical, only one set of such sections will be discussed.

The equatorial line is designated E—E. As in substantially all balls being produced today, this equatorial line is free of dimples and is, in effect, the flash line on the ball as it is removed from the mold. The lattice lines have been indicated on the balls but it is to be understood that these lattice lines do not appear on the finished golf ball for obvious reasons.

Each hemisphere consists of lattice lines forming five large triangles, such as lattice lines 13, 15, and 17. Lattice lines also form smaller triangles, such as lattice lines 21, 23, and 25 and 31, 33, and 35.

This same lattice line configuration exists on the opposite side of the equatorial line of the ball, as indicated by lattice lines 41, 43, and 45 for the larger triangle and lattice lines 51, 53, and 55 and 61, 63, and 65 for the smaller triangles.

As will be evident from viewing the drawings, each of the larger triangles on one hemisphere has one vertex which terminates at pole P, with the other vertices of the triangles being shared by adjacent triangles. Leg 17 of the triangle which is opposite the pole of the ball is substantially parallel to the equator and spaced therefrom.

Each of the smaller triangles has one vertex which is common to a vertex shared by two adjacent, larger triangles. The leg of the smaller triangles, such as leg 25 opposite the vertex shared by the larger triangles, lies on a line parallel to but spaced from the equator of the ball.

In order to provide maximum coverage of the surface with dimples, the present dimple configuration consists of two sets of dimples having different diameters. On all drawings the larger diameter dimples are marked with an L and the smaller diameter dimples are marked with an S.

Figure 4:
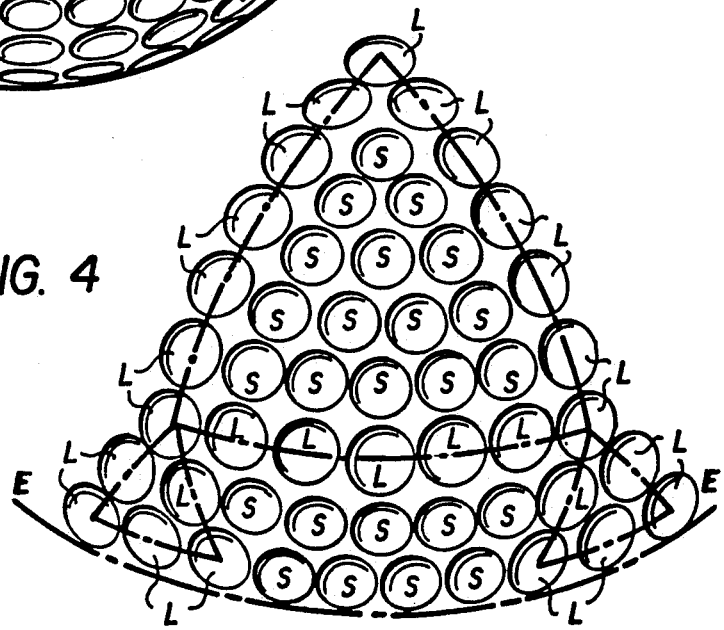
FIG. 4 is a diagramatical presentation of one of the lattice sections of the ball of FIG. 1.

FIG. 4 is a diagramatical representation of one section of the dimple layout. As will be evident, all of the dimples lying along the lattice of the larger triangles and the lattice of the smaller triangles have the larger diameter D1. All of the dimples lying within the lattice of the larger triangle and between the lattice of the smaller triangles have the smaller diameter D2.

Preferably, the diameter D1 of the larger dimples is between 0.148 inch and 0.156 inch, with the preferred diameter being substantially 0.152 inch.

The diameter D2 of the smaller dimples is preferably between 0.126 inch and 0.136 inch, with the preferred diameter being 0.131 inch.

Figure 5:
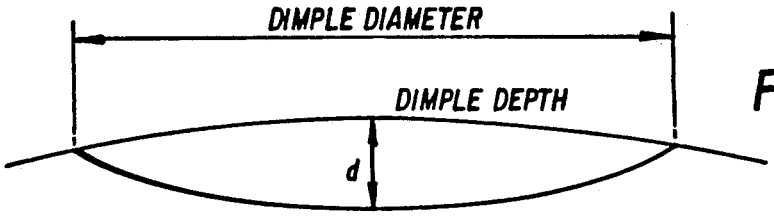
FIG. 5 is a schematic illustration of the dimple diameter and depth.

FIG. 5 illustrates the manner in which the diameter and depth of the dimples are measured.

The depth is measured from the bottom center of the dimple, along the direction being radially projected from the center of the ball, to the projected outer periphery of the ball above the dimple.

The diameter is defined as the chordal distance between the intersections of the ball's periphery and lines drawn tangent to the side dimple walls at 0.003 inch below the periphery of the ball.

The depth d of the larger dimple is preferably between 0.010 inch and 0.013 inch, with the preferred depth being 0.0118 inch. The depth of the smaller dimple is preferably between 0.008 inch and 0.011 inch, with the preferred depth being 0.0098 inch.

In the preferred ball, with the above diameters, there are 162 of the larger dimples and 240 of the smaller dimples, whereby the ball surface is covered by 402 dimples.

The flight characteristics of the ball meet all required U.S.G.A. standards as to symmetry and the ball has excellent performance characteristics as measured by actual tests of the ball as it is being struck by a machine, as discussed above.

It is to be understood that the above description and drawings are illustrative only and that the scope of the invention is to be limited only by the following claims.

We claim:

1. A golf ball having two poles and an equator and having a preselected number of dimples covering the surface of the ball and arranged in a geometrical lattice configuration based upon a modified icosahedral lattice, said lattice and dimples comprising a first set of five adjacent triangles on either side of the equator of the ball, with one of the vertices of each of said triangles being located at each pole of said ball and the sides opposite said polar vertices being spaced a predetermined distance from the equator of said ball;

a second set of five triangles smaller than said first set of triangles equally spaced about said ball between said first set of triangles and said equator of said ball, each of said second set of triangles having a vertex common with the lower vertices of two adjacent ones of said first plurality of triangles, with the leg opposite said common vertex being parallel to but spaced from said equator;

a first plurality of dimples having a diameter D1 lying along the lattice forming said first and second set of triangles;

a second plurality of dimples having a diameter D2 lying within the lattice of said first set of triangles and between the lattice of said second set of triangles;

diameter D1 being greater than the diameter D2; and a dimple-free line about said equator.

2. The golf ball of claim 1 wherein there are 162 dimples having a diameter D1 and 240 dimples having a diameter D2.

3. The golf ball of claim 2 wherein the diameter D1 is between 0.148 inch and 0.156 inch, and the diameter D2 is between 0.126 inch and 0.136 inch.

4. The golf ball of claim 2 wherein the diameter D1 is substantially 0.152 inch and the diameter D2 is substantially 0.131 inch.

5. The golf ball of claim 2 wherein the depth d of the dimples having a diameter D1 is between 0.010 inch and 0.013 inch and the depth of the dimples having a diameter D2 is between 0.008 inch and 0.011 inch.

6. The golf ball of claim 2 wherein the depth d of the dimples having a diameter D1 is substantially 0.0118 inch and the depth d of the diameter of the dimples having a diameter D2 is substantially 0.0098 inch.

* * * * *